US007055686B2

(12) United States Patent
De-Vries

(10) Patent No.: US 7,055,686 B2
(45) Date of Patent: Jun. 6, 2006

(54) TISSUE CONTAINER WITH AUXILIARY COMPARTMENT

(76) Inventor: Liat De-Vries, 61 Dolev Street, Caesarea 38900 (IL)

( * ) Notice: Subject to any disclaimer, the term of this patent is extended or adjusted under 35 U.S.C. 154(b) by 112 days.

(21) Appl. No.: 10/649,865

(22) Filed: Aug. 28, 2003

(65) Prior Publication Data

US 2004/0099545 A1 May 27, 2004

(30) Foreign Application Priority Data

Nov. 14, 2002 (IL) ..... 152867

(51) Int. Cl.
*B65D 77/00* (2006.01)

(52) U.S. Cl. ..... 206/233; 206/216; 206/494; 206/581

(58) Field of Classification Search ..... 206/233, 206/494, 581, 216, 229; 220/521, 522; 221/92
See application file for complete search history.

(56) References Cited

U.S. PATENT DOCUMENTS 2,789,725 A * 4/1957 Carper ..... 401/125
3,307,687 A 3/1967 Steinman
4,702,378 A * 10/1987 Finkel et al. ..... 206/581
5,439,104 A * 8/1995 Wolska-Klis ..... 206/233
5,509,593 A 4/1996 Bloch et al.
6,004,307 A * 12/1999 Colon et al. ..... 604/385.06
6,062,381 A * 5/2000 Paley et al. ..... 206/233
6,170,426 B1 1/2001 Thorsbakken
6,321,937 B1 * 11/2001 DeSimone et al. ..... 221/45
6,457,434 B1 10/2002 Lazar
2001/0023878 A1 9/2001 Irwin
2003/0080018 A1 * 5/2003 Nally ..... 206/494

FOREIGN PATENT DOCUMENTS

JP 37 44 4438 A1 7/1989
WO WO 00/16678 3/2000
WO WO 02/32783 A1 4/2002

* cited by examiner

*Primary Examiner*—David T. Fidei
(74) *Attorney, Agent, or Firm*—Birch, Stewart, Kolasch & Birch, LLP

(57) ABSTRACT

A tissue container comprising a tissue receiving enclosure and a re-closable opening for dispensing tissues there through, and an associated auxiliary compartment holding a preparation for use in conjunction with the tissues.

35 Claims, 5 Drawing Sheets

TISSUE CONTAINER WITH AUXILIARY COMPARTMENT

FIELD OF THE INVENTION

The present invention relates to tissue containers and to dispensers, for dispensing tissues, towelettes and the like from such containers. More particularly the invention is concerned with such tissue containers and dispensers which readily offer use of an associated preparation.

BACKGROUND OF THE INVENTION

In combination with using a tissue (e.g. facial, toilet or other tissues, towelettes, wipes, pads, bandages, etc.), whether of the dry or moistened type, it is frequently advantageous to have a supply and means for conveniently accessing a preparation. A classic example is one in which a baby's diaper is being changed and it is desired to apply some sort of lotion or cream on the baby prior to diapering with a fresh diaper. On the other hand, the lotion may be used prior to using the tissue as in the case of the lotion being a cleansing preparation.

The term preparation or preparations hereinafter in the specification and claims is used in its widest connotation and denotes any liquids or topicals such as ointments, oils, salves, moisturizers, anti-bacterial compositions, rubbing alcohol, perfumes, cleansers and the like, powdered material for different uses e.g. hygienic, medical, cosmetic, cleaning, treating surfaces, etc.

Presently it is necessary to carry a separate container, such as a tube or a jar, of ointment along with the tissues. Thus, one must carry along and search for the ointment and deal with a situation of having more than one item in use. This can be particularly important in the situation when one is changing a baby's diaper in public. In such a case there are presently more items to carry, locate, use and potentially forget and leave behind.

If the preparation and tissues are packaged in an integral or complementary manner, the entire activity is much more convenient and precludes the possibility, for example, of leaving behind an ointment tube at a diaper changing location. It also prevents the possibility of forgetting a preparation container behind.

While prior art such as U.S. Pat. Nos. 6,457,434, 6,170,426 and 5,509,593 disclose various types of tissue dispensers that include some sort of supplementary compartment, container or housing, these dispensers are only designed for wetting a dry tissue or providing a compartment for wet as well as dry tissues. The auxiliary compartments are not amenable for holding a lotion to be applied before or after using the tissue.

U.S. Pat. No. 5,439,104 discloses an eyeglass cleaning station including a compartmented housing containing a dispensing bottle of liquid lens cleaning material and a dispensing box of disposable lens cleaning tissue.

Thus, it is an object of the present invention to provide a tissue container with an auxiliary compartment, attached to or integral with the container, for holding a preparation that is typically used in conjunction with the tissue.

SUMMARY OF THE INVENTION

According to the present invention there is provided a tissue container comprising a tissue receiving enclosure and a re-closable opening for dispensing tissues there through; and an associated auxiliary compartment associated with the container, for holding a preparation for use in conjunction with the tissues. The auxiliary compartment is attached to or integral with the container, or may be provided loose within the tissue container.

By one embodiment, the dispenser comprises a tissue dispensing opening fitted with a re-closable first lid and a re-closable auxiliary compartment.

According to another aspect of the invention there is provided a tissue dispenser for use with a tissue container, said dispenser is formed with a tissue dispensing opening and a receptacle constituting the auxiliary compartment; and a re-closable lid for closing the dispensing opening. According to particular embodiments, the auxiliary compartment is re-closeable.

According to still a further aspect of the invention, there is provided a compartment comprising a preparation for use in conjunction with a tissue, said compartment being an auxiliary compartment included with or attached to a tissue container.

BRIEF DESCRIPTION OF THE DRAWINGS

In order to understand the invention and to see how it may be carried out in practice, some embodiments will now be described, by way of non-limiting examples only, with reference to the accompanying drawings, in which:

FIGS. 1A–1D illustrate a dispensing cover in accordance with an embodiment of the present invention, wherein:

FIG. 1A is an isometric view of the dispensing cover in a closed state;

FIG. 1B is an isometric view, partially sectioned, with a tissue dispensing lid partially open;

FIG. 1C is an isometric view of the dispensing cover with the first lid in its open state;

FIG. 1D is an isometric view with the second lid in its open state, the first lid being closed;

DETAILED DESCRIPTION OF SPECIFIC EMBODIMENTS

Figure 1A:
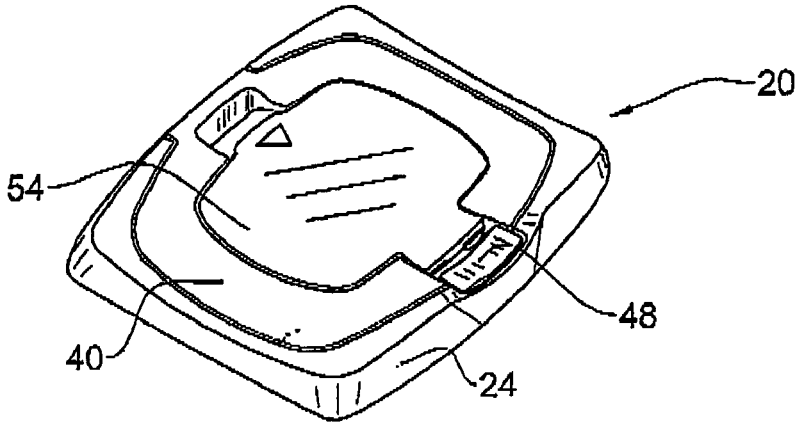
Figure 1B:
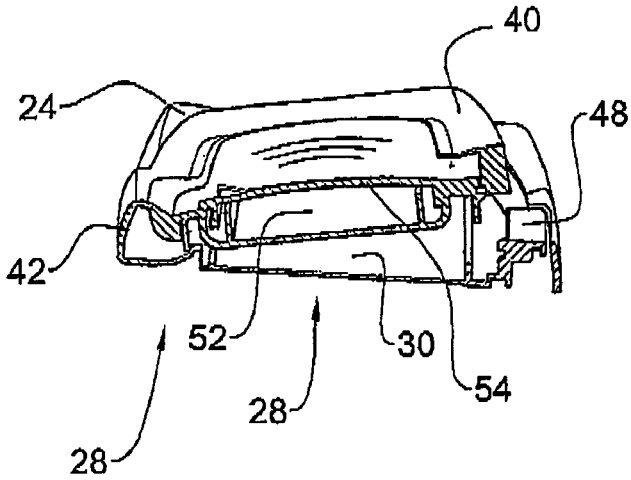

Attention is first directed to FIGS. 1A–1D illustrating a tissue dispensing cover generally designated 20 for use with a tissue container (not shown). It is appreciated that the cover 20 may be used with a variety of tissue containers, e.g. soft pack containers, rigid boxes, etc., and further, that the tissue dispensing opening within the cover may be a regular wide opening or be fitted with some tissue separating means to facilitate dispensing one tissue at a time, as known, per se.

The cover 20 comprises a base portion 24 integral with or attached to the container (not shown) e.g., by an adhesive material, welding, etc. or by snap-type attachment, whereby a tissue dispensing opening of the cover extends opposite a corresponding opening formed in the container.

The cover 20 comprises a tissue dispensing opening 28 (FIG. 1D) which until first used is normally sealed (as in FIGS. 1B and 1C), e.g. by a removable foil or by a breakable/tearable film of plastic material 30 (FIGS. 1B and 1C), serving to retain moist within the tissue container and also as a temper proof evidence.

Figure 1C:
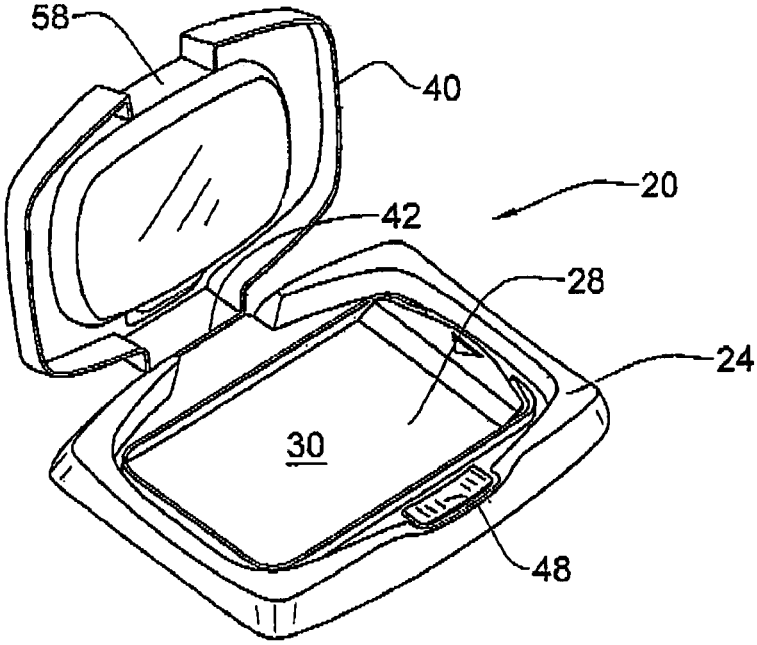
Figure 1D:
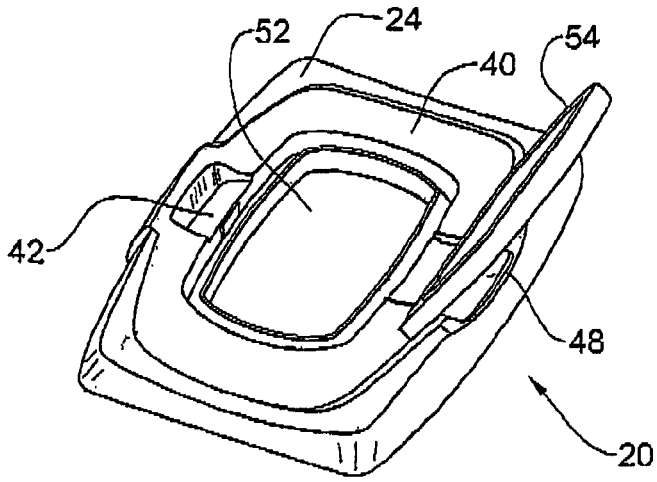

The cover comprises a first lid 40 hingedly pivotted at 42 by means of an integral hinge to the base 24, and being displaceable between a closed position (FIG. 1A) and an open position (FIG. 1C). The first lid 40 is fitted for sealing the tissue dispensing opening 28 to prevent moisture evaporation and in accordance with one particular embodiment, the first lid 40 is biased to snap into its open position, e.g. by means of an integral spring arrangement, or a silicon spring, etc. The first lid is retained in its closed position (FIG. 1A) by a snap-type latch arrangement 48.

Found within the first lid 40 there is an auxiliary compartment designated 52 sealable by a second lid 54 hinged to the first lid 40 and fitted for snap engagement into the first lid by means of a laterally projecting latch 58 snapingly engageable with a corresponding recess formed in the first lid 40.

The auxiliary compartment 52 is fitted for receiving preparations of different kinds e.g. a soothing paste or ointment for applying on a baby's buttocks, a skin comforting gel, a cleaning preparation, etc. The size and sealing means provided for said auxiliary compartment are determined, among others, by the nature of the composition received within the auxiliary compartment.

The arrangement is such that for dispensing a tissue, in dry or moist state from the tissue container, the first lid 40 is opened by depressing latch 48 allowing for easy withdrawal of a tissue, upon which the first lid may be closed. Then, if it is required to make use of the composition received within the auxiliary compartment, e.g. to apply a soothing cream over a baby's buttocks, the second lid 54 is opened providing axis to the auxiliary compartment 52.

Figure 2A:
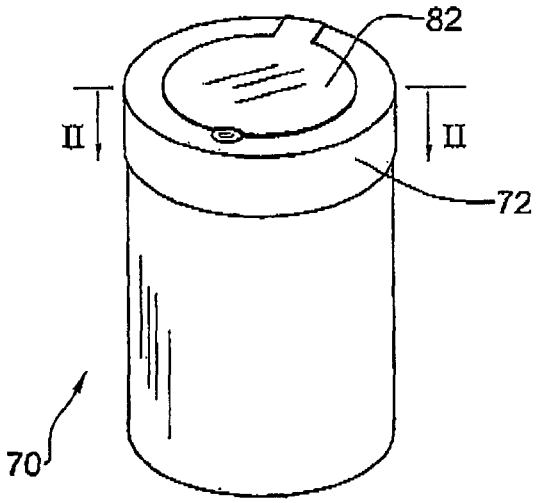
FIG. 2A is a perspective view of a cylindric tissue container fitted with a dispensing cover in accordance with an embodiment of the present invention.
Figure 2B:
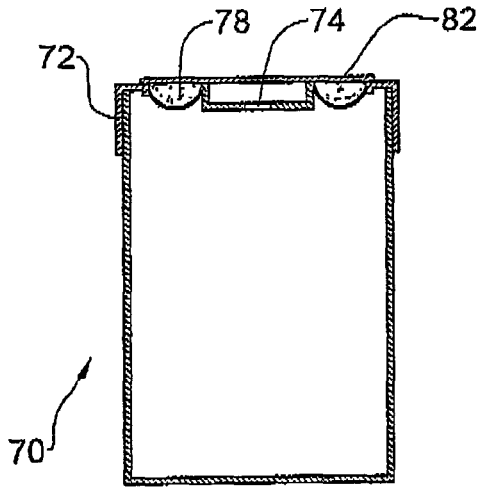
FIG. 2B is a longitudinal section along lines II—II in FIG. 2A.

Turning now to FIGS. 2A and 2B there is illustrated a different embodiment of a tissue container in accordance with the present invention generally designated 70, being a rigid cylindrical container in which tissues are typically provided in a reel with pre-perforated separation between the tissues, as known per se. The container 70 is provided with a dispensing cover 72 fitted with a dispensing slit 74 (FIG. 2B) usually having an X-like shape fitted for extracting excess moisture from the tissues and for ensuring separation of the tissues from one another as a leading tissue is being extracted from the container.

In accordance with the present embodiment, the cover 72 is formed with an annular groove 78 constituting the auxiliary compartment and being sealed by a common lid 82 fitted for sealing engagement of the tissue dispensing opening and the auxiliary compartment 78.

As noted in FIG. 2B, the auxiliary compartment 78 has a U-like cross section which permit for easy access by a fingertip for scooping an ointment or the like received within the auxiliary compartment 78 and ensuring complete use of the ointment, to thus avoid waste of residual material remaining in the auxiliary compartment.

It is appreciated that the lid 82 is fitted for sealing engagement with the cover 78 to thereby prevent leak of material received within the auxiliary compartment and to prevent evaporation of moist received within the container 70.

Figure 3A:
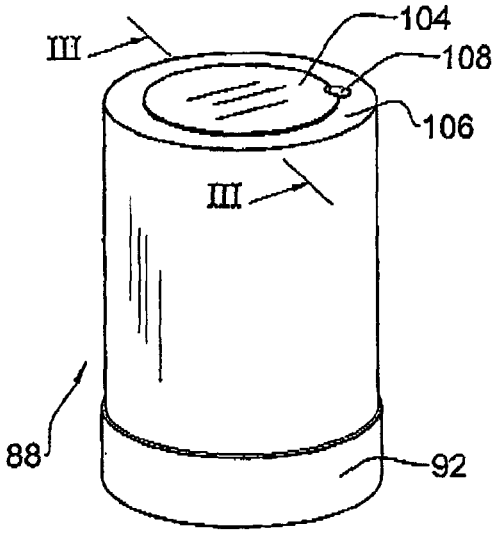
FIG. 3A is an isometric view of a cylindric tissue container in accordance with a different embodiment of the invention.
Figure 3B:
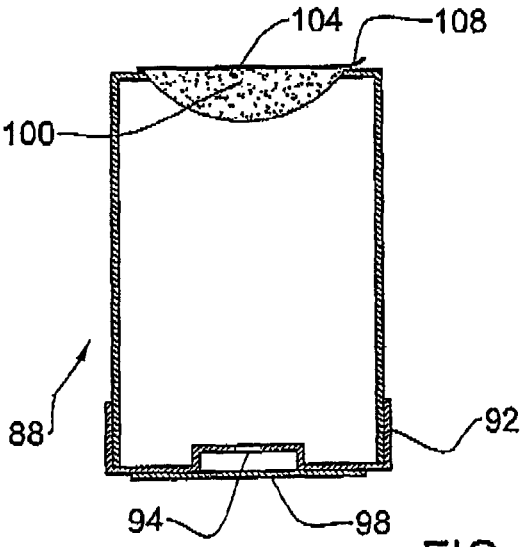
FIG. 3B is a longitudinal section along lines III—III in FIG. 3A.

The embodiment illustrated in FIGS. 3A and 3B discloses a cylindrical tissue container 88 holding a roll of moist tissue dispensable through a dispensing cover 92 fitted with a dispensing opening 94 sealingly closable by a lid 98 (FIG. 3B), as known per se.

Fitted at an opposite side of the container 88 (actually a bottom base thereof) there is an auxiliary compartment 100 in the form of a depression at a base of the container 88 for receiving a preparation and being sealable by a reclosable lid, e.g. foil 104 which is fitted with an adhesive parameter for resealing over a parameter portion 106 of the base portion, as designated by dashed lines in FIG. 3A. For the sake of convenience, the foil 104 is fitted with a tab 108.

However, according to a modification (not shown) the auxiliary compartment can also be an add-on type fitted for attachment at the bottom end of the container e.g. by snap engagement, adhering, etc. Furthermore, according to another embodiment (not shown) once the tissue container becomes empty, the auxiliary compartment may be detachable from the container, for attaching to a fresh tissue container.

Figure 4A:
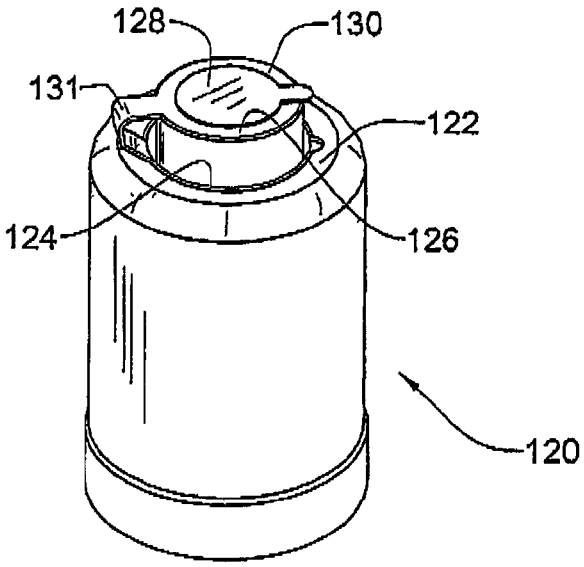
FIG. 4A is an isometric view of a top portion of a cylindric tissue container in accordance with still another embodiment of the invention, with the lid partially opened.
Figure 4B:
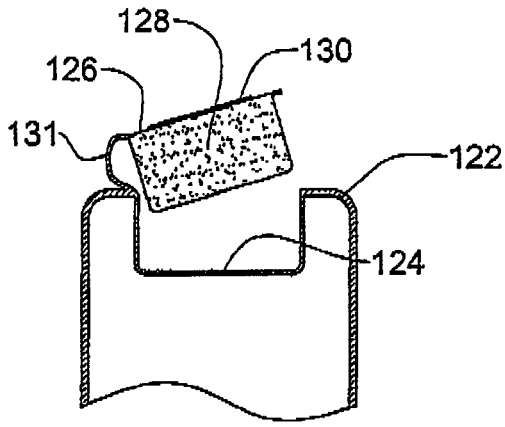
FIG. 4B is a section of a top portion of the container illustrated in FIG. 4A in the same respective position of the lid.

Turning now to FIG. 4 there is illustrated still another embodiment of a tissue container 120 which in the present embodiment is also a cylindrical tissue container. The container is formed with a tissue dispensing cover 122 formed with a tissue dispensing opening 124 sealingly closable by a tissue dispensing lid 126. Formed at an upper portion of lid 126 there is formed an auxiliary compartment 128 sealable by a second lid 130 e.g. in the form of a sealable foil or a snap-type cover. In the present embodiment the tissue dispensing lid 126 is attached to the cover 122 by an integral hinge at 131.

Figure 5A:
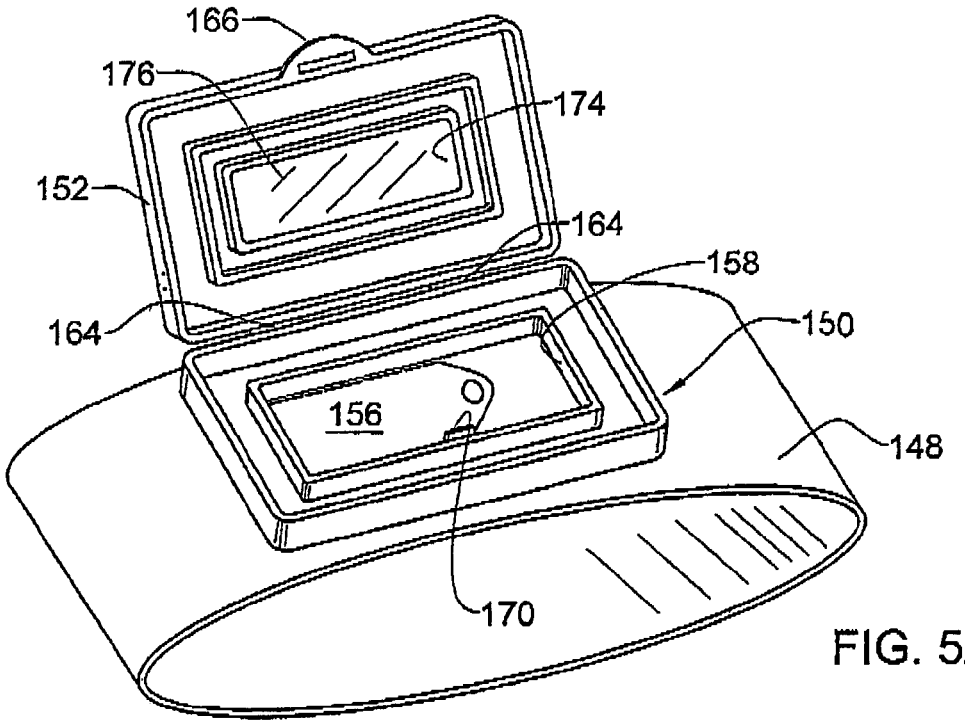
FIG. 5A is an isometric view of a soft-packed tissue container fitted with a dispensing cover in accordance with an embodiment of the present invention, the dispensing lid in its open state.
Figure 5B:
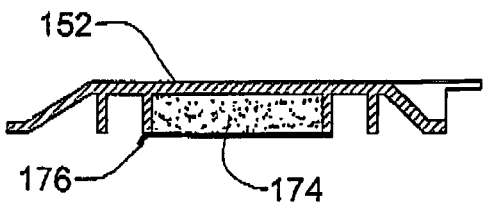
FIG. 5B is a section of a top portion of the container in FIG. 5A with the lid in its closed state.

The embodiment depicted in FIGS. 5A and 5B refers to a tissue container 148 being a soft-pack type container, fitted with a rigid dispensing cover generally designated 150, fitted in turn with a lid 152 which in FIG. 5A is open and in FIG. 5B is closed.

A dispensing opening formed in the container is in register with a dispensing opening in the dispensing cover 150 and is a priori sealed with a removable foil 156 (not seen in FIG. 5B) which may be resealable. The dispensing opening 158 may be provided, as already mentioned before, with separation means (not shown) to facilitate removal of one tissue at a time, as known in the art.

Lid 152 is integrally hinged at 164 to the dispensing cover 150 and is fitted with a lifting tab 166. Lid 152 is adapted for snap engagement with a latch 170 projecting within the dispensing opening 158.

Lid 152 is formed with an auxiliary compartment 174 extending from the inner face of the lid and being sealable, e.g. by means of a adhering foil 176 or by means of a reclosable lid, hinged or removable (not shown). The auxiliary compartment 174 may have a rectangular cross-section as seen in FIGS. 5A and 5B or else it may be compartmented into several sub-auxiliary compartments (not shown), each such sub-compartment being independently sealable or resealable.

Where more than one auxiliary compartment is provided—different compositions may be received therein, e.g. different types of preparations, medicaments or cleaning agents, etc.

Figure 6:
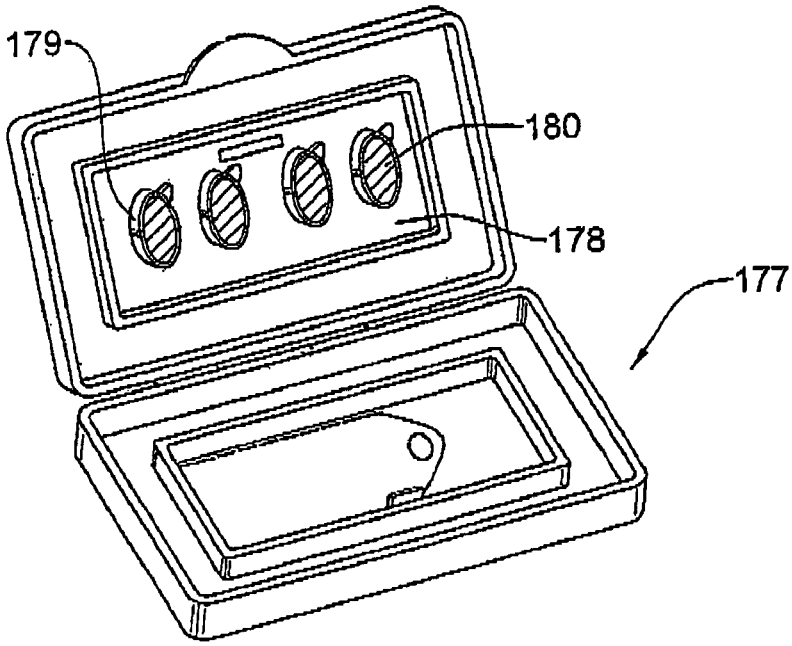
FIG. 6 is an isometric view of a dispensing cover in its open state illustrating a modification of the embodiment seen in FIG. 5A.

In FIG. 6 there is illustrated an embodiment similar to that disclosed in FIGS. 5A and 5B wherein the dispensing cover generally designated 177 comprises an auxiliary compartment 178 formed with a plurality of depressions 179 forming sub-compartments, each sealable with a foil 180. The compartments may be sized to receive a quantity of preparation suitable for a single use wherein the foil would be a removable seal or where the amount of preparation received in the auxiliary compartment be sufficient for more than one serving, then the foil would be resealable.

Figure 7:
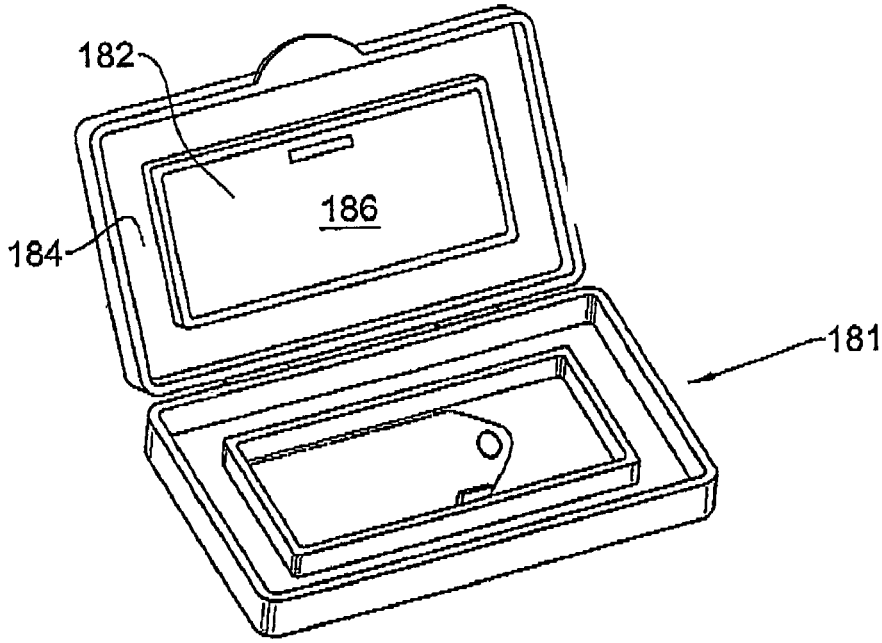
FIG. 7 is an isometric view illustrating a dispensing cover in accordance with an embodiment of the invention.

Turning now to FIG. 7 there is illustrated still a different embodiment wherein the dispensing cover 181 is principally similar to that illustrated in FIG. 5A with the difference that the auxiliary compartment 182 formed in the first lid 184 comprises a second lid 186 or a re-adherable foil, and where the auxiliary compartment 182 is suited for receiving a preparation.

Figure 8A:
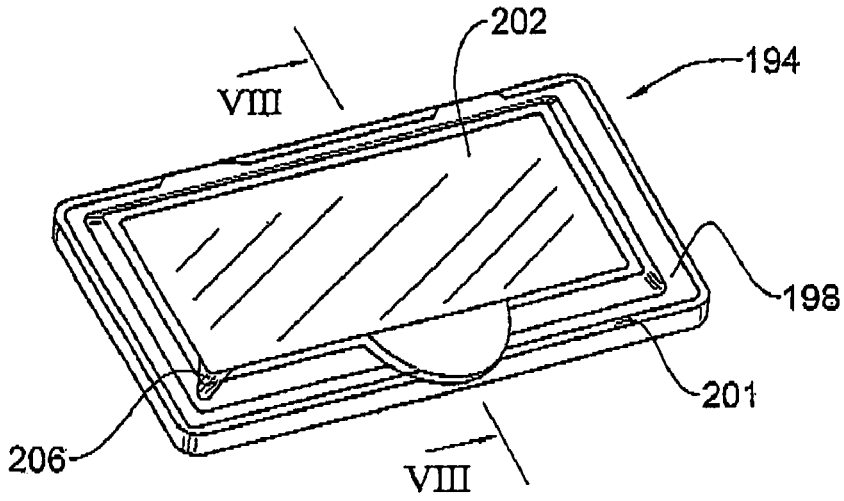
FIG. 8A is a top isometric view of a dispensing cover for use with a tissue container in accordance with another embodiment of the present invention.
Figure 8B:
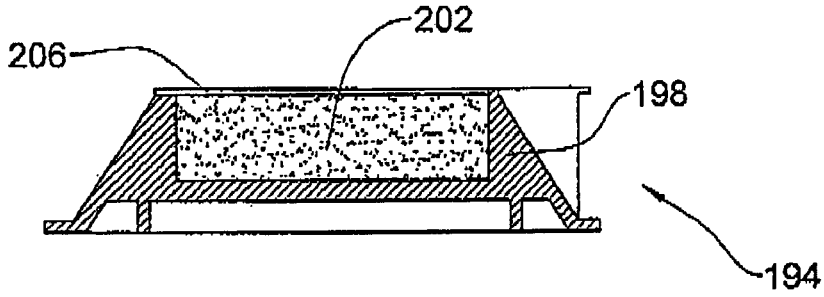
FIG. 8B is a section along lines VIII—VIII in FIG. 8A.

Still another embodiment illustrated in FIGS. 8A and 8B refers to a dispensing cover generally designated 194 of the general type as disclosed in connection with FIGS. 5 and 6, where a tissue dispensing lid 198 is closable over the dispensing opening 201 (FIG. 8A), preferably in a sealing manner. Formed at an outside face of the tissue dispensing lid 198 there is formed an auxiliary compartment 202 sealable by means of a resealable foil 206. However, it is appreciated that rather than a resealable foil there may be provided a reclosable lid attached to or integral from said lid 198.

Figure 9:
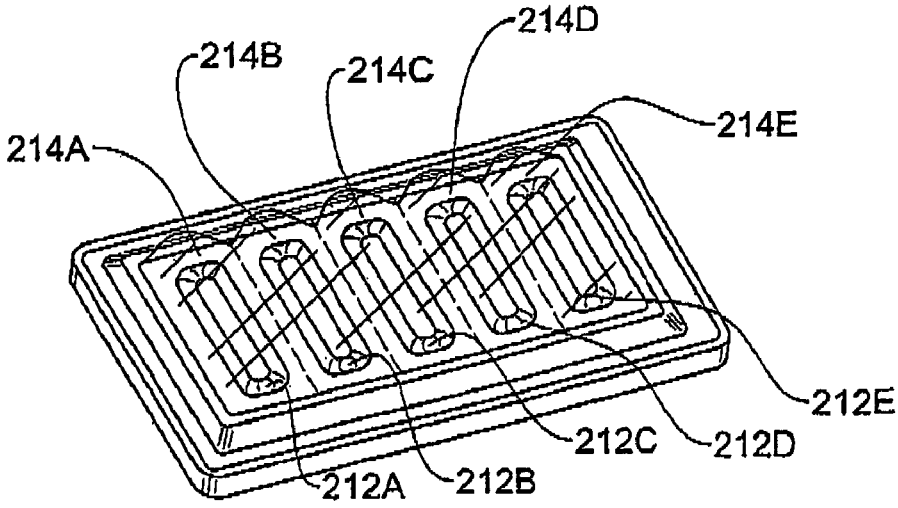
FIG. 9 is a top view illustrating a further modification of the dispensing cover in FIG. 8A.

Furthermore, rather than being a uniform auxiliary compartment, there may be several embodiments wherein the auxiliary compartment is compartmented as illustrated for example in FIG. 9, wherein several auxiliary compartments 211A to 212E, each individually sealed by a foil portion 214A to 214E, corresponding with the sub-compartments. The sub-compartments 212A to 212E may have a U-like cross-section to facilitate easy scooping therefrom.

Whilst some embodiments have been described and illustrated with reference to some drawings, the artisan will appreciate that many variations are possible which do not depart from the general scope of the invention, mutatis, mutandis.

The invention claimd is:

1. A tissue container comprising a tissue receiving enclosure and a re-closable tissue dispensing opening for dispensing tissues therethrough, and an associated recloseable auxiliary compartment holding a preparation for use in conjunction with the tissues, wherein said tissue dispensing opening is fitted with a re-closable first lid, and wherein the auxiliary compartment is fitted with a re-closable second lid that is pivotally hinged to the first lid.

2. A tissue container according to claim 1, wherein the auxiliary compartment is attached to, integral with, or loosely received within the container.

3. A tissue container according to claim 1, wherein the tissue receiving enclosure holds a plurality of moistened tissues and where the opening is fitted with a dispenser for dispensing one tissue at a tima.

4. A tissue container according to claim 3, wherein the auxiliary compartment is integral with or attached to the dispenser.

5. A tissue container according to claim 1, wherein the first lid and the second lid are hinged to the dispenser about pivot binges that extend parallel to each other.

6. A tissue container according to claim 5, wherein the first lid and the second lid are hinged to the dispenser adjacent opposite edges of the dispenser.

7. A tissue container according to claim 1, wherein the auxiliary compartment is fanned in said first lid and is re-closable by a detachable cover.

8. A tissue container according to claim 7, wherein the auxiliary compartment is formed at an outside face of the first lid.

9. A tissue container according to claim 1, wherein one or both of the first lid and the second lid are biased to spring-open.

10. A tissue container according to claim 1, wherein one or both of the first lid and the second lid are fitted with a snap-type closing mechanism.

11. A tissue container according to claim 1, wherein one or both of the tissue dispensing opening and the auxiliary compartment are pro-sealed with a foil.

12. A tissue container according to claim 1, wherein the container is a soft-pack.

13. A tissue container according to claim 1, wherein the container is rigid.

14. A tissue container according to claim 1, wherein the container is portable.

15. A tissue container according to claim 1, wherein said second opening is closeable at least when said first lid is in the open position.

16. A tissue container according to claim 1, wherein said second opening is closeable when said first lid is in the closed position.

17. A cover according to claim 1, wherein said preparation comprises a liquid or topical ointment, oil, salve, moisturizer, anti-bacterial composition, rubbing alcohol, perfume, cleanser or powdered material for hygienic, medical, cosmetic, cleaning or surface treatment use.

18. A dispensing,g cover for use with a tissue container, comprising:

(a) a base portion adapted for attachment to a said container and having a first tissue dispensing opening;

(b) a first lid hingedly pivoted with respect to said base and being displaceable between a closed position and an open position with respect to said first opening;

(c) at least one auxiliary compartment adapted for containing therein a preparation for use in conjunction with tissues, said at least one auxiliary compartment comprising a recloseable second opening that is closeable at least when said first lid is in the open position.

19. A cover according to claim 18, wherein said base portion is adapted for detachable engagement with a base portion of a tissue container.

20. A cover according to claim 18, wherein the at least one auxiliary compartment is integral with or attached to the cover.

21. A cover according to claim 18, wherein the at least one auxiliary compartment is formed in said first lid.

22. A cover according to claim 21, wherein the at least one auxiliary compartment is formed at an outside face of said first lid.

23. A cover according to claim 22, wherein the at least one auxiliary compartment is closeable by any one of a re-sealable movable foil or a breakable flint of plastic material or a tearable film of plastic material, or by a detachable cover.

24. A cover according to claim 22, wherein the at least one auxiliary compartment is sealingly closeable by a second lid.

25. A cover according to claim 24, wherein the at least one auxiliary compartment is comprised in said first lid, and said second lid is pivotably hinged to said fast lid.

26. A cover according to claim 24, wherein the first lid and the second lid arc hinged to the dispenser about pivot binges that extend parallel to each other.

27. A cover according to claim 26, wherein the first lid and the second lid are hinged with respect to the cover adjacent opposite edges of the cover.

28. A dispenser cover according to claim 26, wherein one or both of the first lid and the second lid are biased to spring-open.

29. A dispenser cover according to claim 26, wherein one or both of the first lid and the second lid are fitted wit a snap-type closing mechanism.

30. A cover according to claim 18, wherein said second opening is closeable when said first lid is in the closed position.

31. A cover according to claim 18, wherein said at least one auxiliary compartment contains a suitable preparation.

32. A cover according to claim 31, wherein said preparation comprises a liquid or topical ointment oil, salve, moisturizer, anti-bacterial composition, rubbing alcohol, perfume, cleanser or powdered material for hygienic, medical, cosmetic, cleaning or surface treatment use.

33. A cover according to claim 18, wherein the auxiliary compartment is associated with one of said first opening and said first lid.

34. A tissue container, comprising a tissue receiving enclosure and a first, tissue dispensing opening for dispensing tissues therethrough, and further comprising a cover as defined in claim 18, said first opening being reversibly closeable by said first lid.

35. A tissue container comprising:

(i) a tissue receiving enclosure and a first, tissue dispensing opening for dispensing tissues therethrough, said first opening being closeable by a hinged first lid;

(ii) at least one auxiliary compartment associated with one of said first opening and said first lid;

(iii) said auxiliary compartment containing therein a preparation for use in conjunction with tissues, and a cover formed with a tissue dispensing opening and at least one receptacle constituting the at least one auxiliary compartment, wherein said first lid is re-closable and formed with said cover.

* * * * *

UNITED STATES PATENT AND TRADEMARK OFFICE

CERTIFICATE OF CORRECTION

PATENT NO. : 7,055,686 B2
APPLICATION NO. : 10/649865
DATED : June 6, 2006
INVENTOR(S) : Liat De-Vries It is certified that error appears in the above-identified patent and that said Letters Patent is hereby corrected as shown below:

In the Claims:

Column 6, line 16 “fanned” should read --formed--.

Column 6, line 47 delete “g” after the word “dispensing”.

Column 7, line 6 “flint” should read --film--.

Column 7, line 24 “wit” should read --with--.

Signed and Sealed this

Twenty-eighth Day of November, 2006

JON W. DUDAS
*Director of the United States Patent and Trademark Office*